US011162751B2

(12) United States Patent
Macy

(10) Patent No.: US 11,162,751 B2
(45) **Date of Patent: *Nov. 2, 2021**

(54) METHOD AND APPARATUS FOR PROVIDING A GRIP MODULE ABLE TO HOUSE A FIRING CONTROL UNIT

(71) Applicant: Black Site, Inc., Houston, TX (US)

(72) Inventor: Omar Macy, Houston, TX (US)

(73) Assignee: Black Site, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/689,920

(22) Filed: Nov. 20, 2019

(65) Prior Publication Data

US 2020/0103191 A1 Apr. 2, 2020

Related U.S. Application Data

(63) Continuation of application No. 15/892,397, filed on Feb. 8, 2018, now abandoned.

(Continued)

(51) Int. Cl.
*F41A 19/15* (2006.01)
*F41A 3/66* (2006.01)

(Continued)

(52) U.S. Cl.
CPC ..... *F41A 19/15* (2013.01); *F41A 3/66* (2013.01); *F41A 11/02* (2013.01); *F41A 19/10* (2013.01);

(Continued)

(58) Field of Classification Search
CPC .. F41A 19/10; F41A 19/15; F41A 3/66; F41A 11/02

(Continued)

(56) References Cited

U.S. PATENT DOCUMENTS 5,806,228 A * 9/1998 Martel ..... F41G 11/003 42/124
2007/0006510 A1* 1/2007 McCormick ..... F41A 19/12 42/75.02

(Continued)

OTHER PUBLICATIONS

Kenneth E. Melson, Acting Director, Jul. 25, 2011, Definitions, U.S. Dept. of Justice, Bureau of Alcohol, Tobacco, Firearms and Explosives, pp. 1-4. (Year: 2011).*

*Primary Examiner* — Bret Hayes
(74) *Attorney, Agent, or Firm* — James M. Wu; JW Law Group

(57) ABSTRACT

A modified assembly configured for firearm capable of propelling ammunition is disclosed. The modified assembly, in some embodiments, includes a firing control unit ("FCU") and a grip module. The FCU is a serialized trigger mechanism capable of initiating a directional object when a trigger of the FCU is pulled. The grip module, in some aspects, includes a hand grip, FCU housing, and rear stabilizing connector wherein the FCU housing is configured to house a removable FCU. The rear stabilizing connector, for example, is capable of coupling to a rear attachment for enhancing stability of the modified assembly. In alternative embodiments, the modified assembly further includes a slide assembly, barrel, barrel block, bolt, and return spring situated in the vicinity of the FCU for facilitating object launching process.

18 Claims, 7 Drawing Sheets

Related U.S. Application Data

(60) Provisional application No. 62/456,490, filed on Feb. 8, 2017, provisional application No. 62/456,499, filed on Feb. 8, 2017.

(51) Int. Cl.

| | |
|---|---|
| ***F41A 19/10*** | (2006.01) |
| ***F41A 11/02*** | (2006.01) |
| ***F41C 23/12*** | (2006.01) |
| ***F41G 11/00*** | (2006.01) |
| ***F42B 39/02*** | (2006.01) |

(52) U.S. Cl.
CPC ..... *F41C 23/12* (2013.01); *F41G 11/001* (2013.01); *F42B 39/02* (2013.01)

(58) Field of Classification Search
USPC ..... 42/16, 69.01, 69.02, 69.03
See application file for complete search history.

(56) References Cited

U.S. PATENT DOCUMENTS

| | | | | |
|---|---|---|---|---|
| 2007/0261284 | A1* | 11/2007 | Keng | F41C 23/22 42/73 |
| 2099/0071053 | | 3/2009 | Thomele et al. | |
| 2010/0000138 | A1* | 1/2010 | Brown | F41A 29/00 42/90 |
| 2014/0144061 | A1* | 5/2014 | Bosco | F41C 23/12 42/94 |
| 2015/0153125 | A1* | 6/2015 | Button | F41A 17/82 42/69.01 |
| 2016/0047615 | A1* | 2/2016 | Tubb | F41A 19/16 42/69.01 |
| 2016/0282075 | A1* | 9/2016 | Colman | F41A 19/46 |
| 2017/0167812 | A1* | 6/2017 | Shaver | F41A 11/02 |
| 2017/0184365 | A1* | 6/2017 | Zajk | F41A 21/00 |
| 2018/0100712 | A1* | 4/2018 | Tompkins | F41A 11/00 |

* cited by examiner

METHOD AND APPARATUS FOR PROVIDING A GRIP MODULE ABLE TO HOUSE A FIRING CONTROL UNIT

PRIORITY

This patent application is a continuation patent application of U.S. patent application having a U.S. patent application Ser. No. 15/892,397, filed on Feb. 8, 2018 in the name of the same inventor and entitled "Method and Apparatus for Providing A Grip Module able to House A Firing Control Unit," which also claims the benefit of priority based upon U.S. Provisional Patent Application Ser. No. 62/456,490, filed on Feb. 8, 2017 in the name of the same inventor and entitled "Firearm Grip Module," and U.S. Provisional Patent Application Ser. No. 62/456,499, filed on Feb. 8, 2017 in the name of the same inventor and entitled "Firearm Grip Module Conversion," all of which are incorporated herein by reference in their entirety.

FIELD

The embodiments of present invention relate to firearms. More specifically, the present invention relates to receivers of guns.

BACKGROUND

A conventional gun, such as a rifle and/or pistol containing a striker is able to strike the casing of the ammunition to ignite the primer and discharge the projectile. For example, when a trigger of pistol is pulled, the sear releases the striker, allowing the striker spring to displace the striker forward so that the striker strikes the ammunition to launch a bullet. Typically, the guns include different types of firearms which include, but not limited to, semiautomatic rifles (i.e., Ruger SR-556, Smith & Wesson M&P15-22, CMMG Mk47 Mutant), bullpup firearms (i.e., Kel-Tec KSG, Kel-Tec RDB, M17S556), and/or machine guns (i.e., TEC 9, NP9, Honey Badger PDW).

A problem associated with the conventional guns is that the components of the different types of the guns are not interchangeable.

SUMMARY OF THE INVENTION

Embodiments of the presently claimed invention disclose a modified assembly configured for various styles of firearms capable of firing ammunition. The modified assembly, in some embodiments, includes a firing control unit ("FCU") and a grip module. The FCU is a serialized trigger mechanism capable of initiating a directional object when a trigger of the FCU is pulled. The grip module, in some aspects, includes a hand grip, FCU housing, and rear stabilizing connector wherein the FCU housing is configured to house a removable FCU. The rear stabilizing connector, for example, is capable of coupling to a rear attachment for enhancing stability of the modified assembly. In alternative embodiments, the modified assembly further includes a slide assembly, barrel, barrel block, bolt, and return spring situated in the vicinity of the FCU for facilitating object launching process. The modified assembly, in some embodiments, includes an upper receiver configured to couple to the grip module for enclosing the FCU, the slide assembly, and the return spring between the upper receiver and the grip module. A rear attachment, in some examples, can be coupled to the rear stabilizing connector and configured to facilitate stability of the modified assembly during a process of launching the object.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
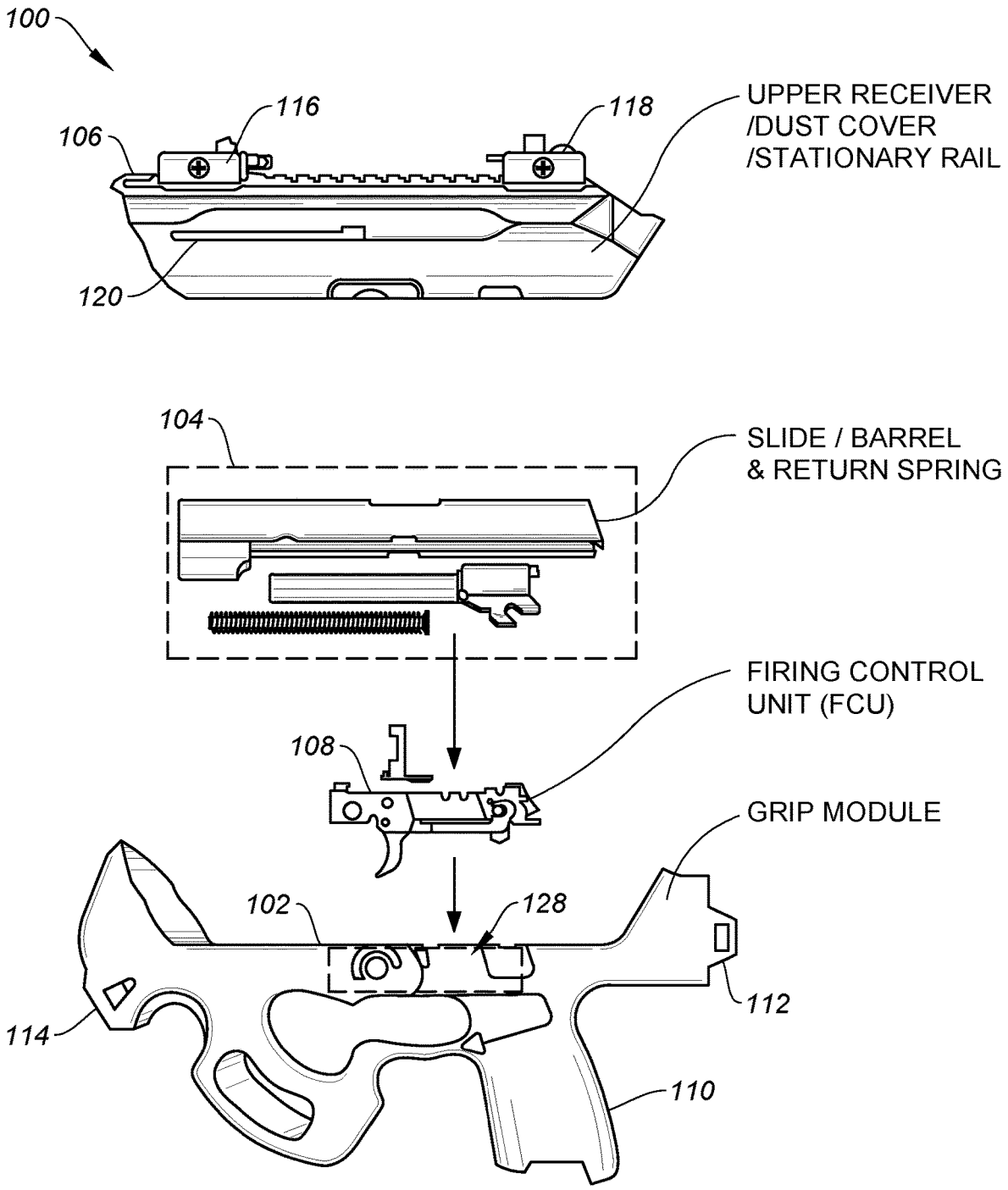
FIG. 1 is a diagram illustrating a grip module and FCU in accordance with one embodiment of the present invention.

Exemplary embodiment(s) of the present invention is described herein in the context of a method, system and apparatus of modifying a firearm using a grip module and FCU.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

One embodiment of the presently claimed invention discloses a modified assembly configured for firearm capable of propelling ammunition. The modified assembly, in some embodiments, includes a firing control unit ("FCU") and a grip module. The FCU is a serialized trigger mechanism capable of initiating a directional object when a trigger of the FCU is pulled. The grip module, in some aspects, includes a hand grip, FCU housing, and rear stabilizing connector wherein the FCU housing is configured to house a removable FCU. The rear stabilizing connector, for example, is capable of coupling to a rear attachment for enhancing stability of the modified assembly. In alternative embodiments, the modified assembly further includes a slide assembly, barrel, barrel block, bolt, and return spring situated in the vicinity of the FCU for facilitating object launching process. The modified assembly, in some embodiments, includes an upper receiver configured to couple to the grip module for enclosing the FCU, the slide assembly, and the return spring between the upper receiver and the grip module. A rear attachment, in some examples, can be coupled to the rear stabilizing connector and configured to facilitate stability of the modified assembly during a process of launching the object.

FIG. 1 is a diagram 100 illustrating a grip module and FCU in accordance with one embodiment of the present invention. Diagram 100, in some embodiments, includes a grip module 102, FCU 108, internal components 104, and upper receiver 106. Internal components 104 includes, but not limited to, a slide assembly, a barrel, a barrel block, a bolt, and/or return spring. Grip module 102, in one example, can also be referred to as bottom receiver. It should be noted that the underlying concept of the exemplary embodiment(s) of the present invention would not change if one or more components (or elements) were added to or removed from diagram 100.

Grip module 102, in some embodiments, includes a handle or grip 110, an FCU housing 128, a rear stabilizing connector 112, and a trunnion 114. Grip 110 can be resized to better accommodate smaller or larger hands of a user. In one example, grip 110 is configured to be hollow capable of receiving a magazine of ammunition. It should be noted that grip 110 can be designed to a grip similar to a particular model of firearm. FCU housing 128, in some embodiments, is configured to FCU or FCU module 108. In an alternative embodiment, grip module 102 is configured to accept any one or more of the upper components of the original firearm (such as the barrel, barrel block, bolt, strike, and/or slide assembly) in addition to FCU module 108.

Rear stabilizing connector 112, in some embodiments, is configured to accommodate an arm brace, buttstock, or cheek rest attachment. For example, grip module 102 can be designed as a Short Barrel Rifle ("SBR"), which would convert a pistol or rifle to an SBR or act as an alternative grip module for an existing SBR. In one aspect, the rear attachment, such as an arm brace, cheek rest, or buttstock, is configured to be optionally added or removed from rear stabilizing connector 112. In another aspect, the rear attachment such as buttstock could be designed to be stationary or collapsing, and could also be designed to incorporate a spare magazine holster. A function of the rear attachment such as an arm brace or buttstock is to provide stability of the modified assembly during a firing operation.

Upper receiver 106, in some embodiments, is configured to take the form of an upper receiver with the option of a mounting point, a dust cover, which could use the upper components from the original firearm or new components, a trunnion, or a stationary rail. For example, upper receiver 106 contains scope latches 116-118 which will be used to secure a scope for aiming. Upper receiver 106, in one example, includes an opening for the movement of a bolt and bolt carrier associated with firearm cocking as indicated by numeral 120. Upper receiver 106 further includes a serial displaying window which will be used to show the original serial number of FCU when FCU is inserted into FCU housing 128.

An advantage of employing grip module is that it provides accessory options, capability enhancements, customization options, and other options not available on the otherwise available firearms.

Figure 2A:
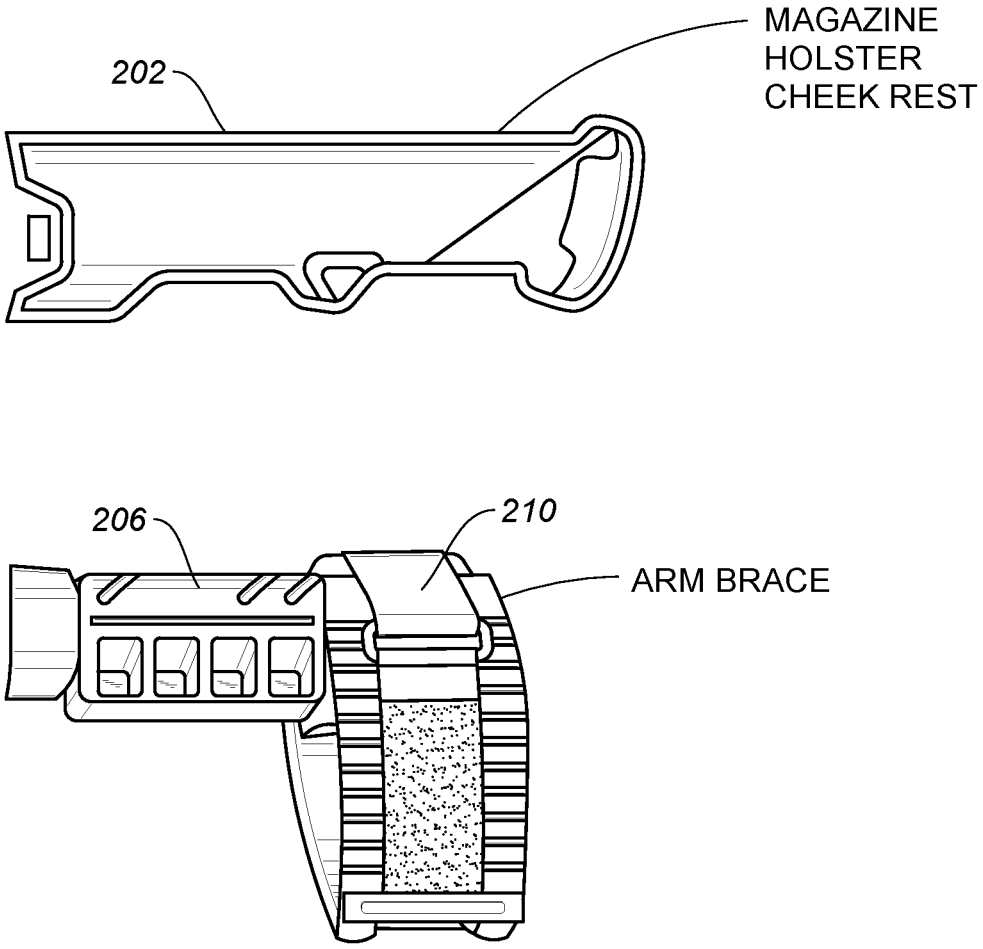
FIGS. 2A-B are diagrams illustrating rear attachments to the grip module in accordance with one embodiment of the present invention.

FIG. 2A illustrates an arm brace 206 and a magazine holster cheek rest 202 capable of being attached to the rear stabilizing connector in accordance with one embodiment of the present invention. Arm brace 206, in one example, can be connected to the rear stabilizing connector of the grip module for providing stability. A strip 210 which can be part of arm brace 206 is used to provide additional stability support. Cheek rest 202, in some embodiments, can be a magazine holster for carrying additional ammunition. Alternatively, cheek rest 202 can be a solid piece for cheek resting. It should be noted that the underlying concept of the exemplary embodiment(s) of the present invention would not change if one or more components (or elements) were added to or removed from diagrams 202 or 206.

Figure 2B:
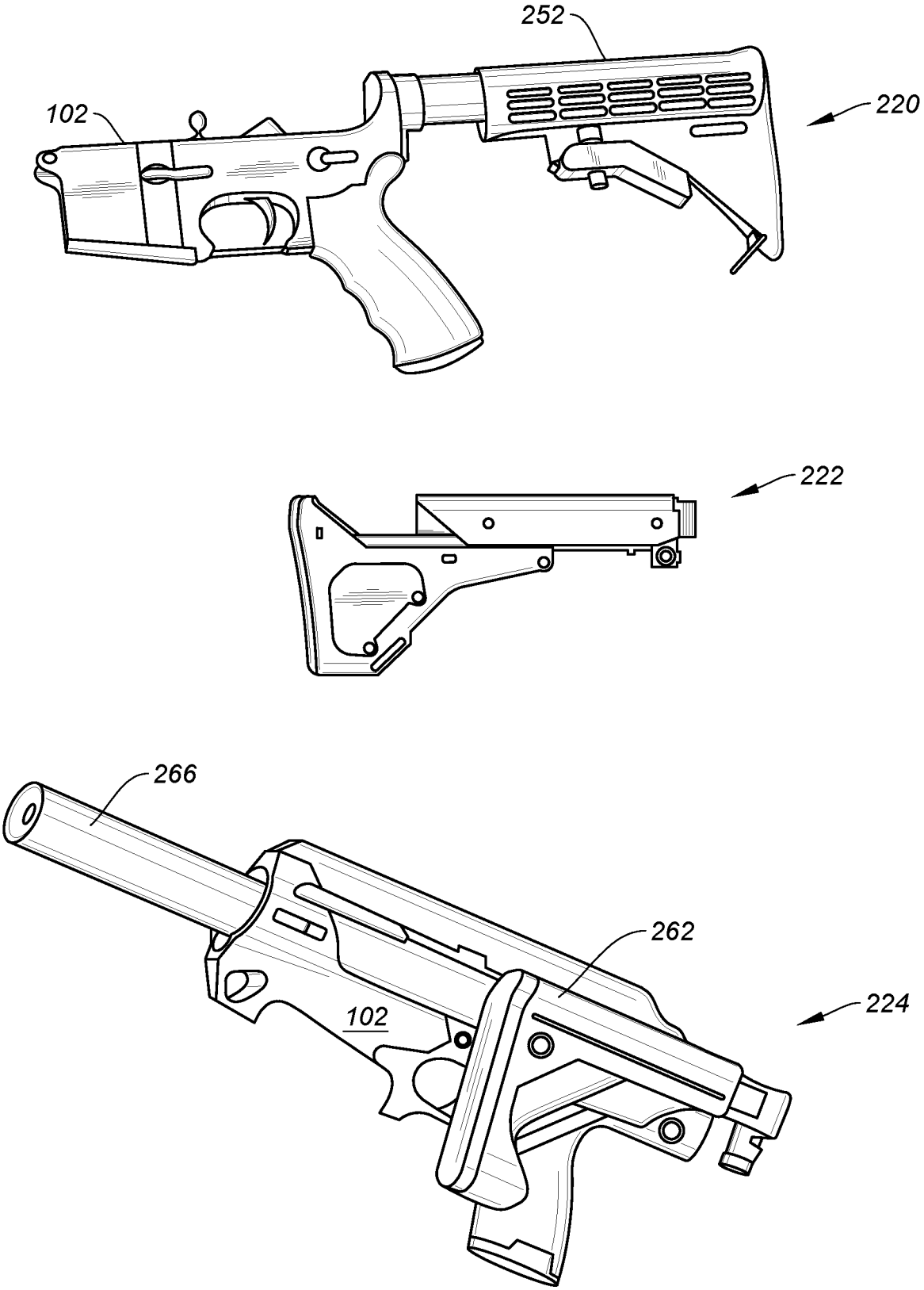

FIG. 2B illustrates diagrams 220-224 showing rear attachments capable of being attached to the grip module in accordance with one embodiment of the present invention. Diagram 220 illustrates a buttstock 252 attached to grip module 102 or lower receiver. In one aspect, buttstock 252 is removable but it is stationary when it is connected. Diagram 222 shows an alternative type of buttstock which can be similar to buttstock 252. Diagram 224 illustrates a modified assembly containing barrel 266, grip module 102, and buttstock 262. In one aspect, buttstock 262 is collapsible by holding buttstock 262 in 180 degrees. It should be noted that the underlying concept of the exemplary embodiment(s) of the present invention would not change if one or more components (or elements) were added to or removed from diagrams 220-224.

Figure 3:
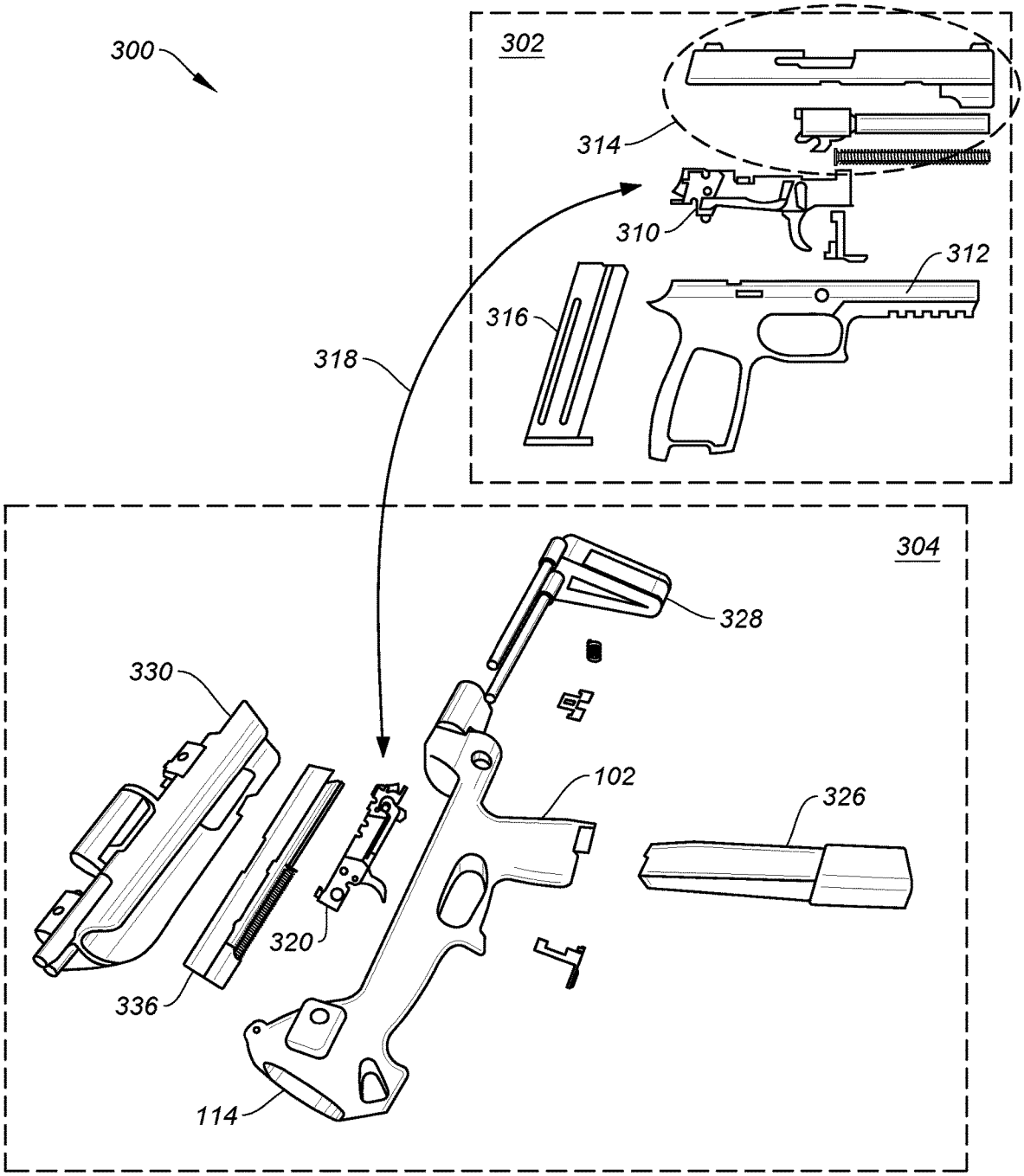
FIG. 3 is a diagram illustrating a conversion process using the same FCU with different bodies in accordance with one embodiment of the present invention.

FIG. 3 is a diagram 300 illustrating a conversion process using the same FCU with different bodies in accordance with one embodiment of the present invention. Diagram 300 includes a pistol 302 and a modified assembly 304 which is configured to resemble as a NP9 like submachine gun. In some embodiments, modified assembly 304 is configured to incorporate usage of FCU 320 which is the same or substantially the same as FCU 310 used in pistol 302. It should be noted that the underlying concept of the exemplary embodiment(s) of the present invention would not change if one or more components (or elements) were added to or removed from diagram 300.

Pistol 302, in some embodiments, includes FCU 310, pistol receiver 312, magazine 316, and internal components 314 which includes a slide assembly, barrel, and return spring. Pistol 302, in one example, can be the Glock model 17 which can be easily disassembled to separate FCU 310 from pistol 302. FCU 310, in one embodiment, can be refitted into modified assembly 304 as indicated by numeral 318.

Modified assembly 304, in one embodiment, includes a grip module 102, magazine 326, internal components 336, upper receiver 330, and FCU 320 which is similar or the same as FCU 310. Internal components 336 includes, but not limited to, a slide assembly, a barrel, a barrel block, a bolt, and/or return spring. Grip module includes a rear stabilizing connector which is used to couple to a buttstock 328. It should be noted that when modified assembly 304 is assembled with FCU 320, the assembly should resemble a semiautomatic machine gun such as NP9.

An advantage of using a grip module is that it facilitates a conversion from a pistol like firearm to a rifle or machine gun like firearm using similar FCU modules.

Figure 4:
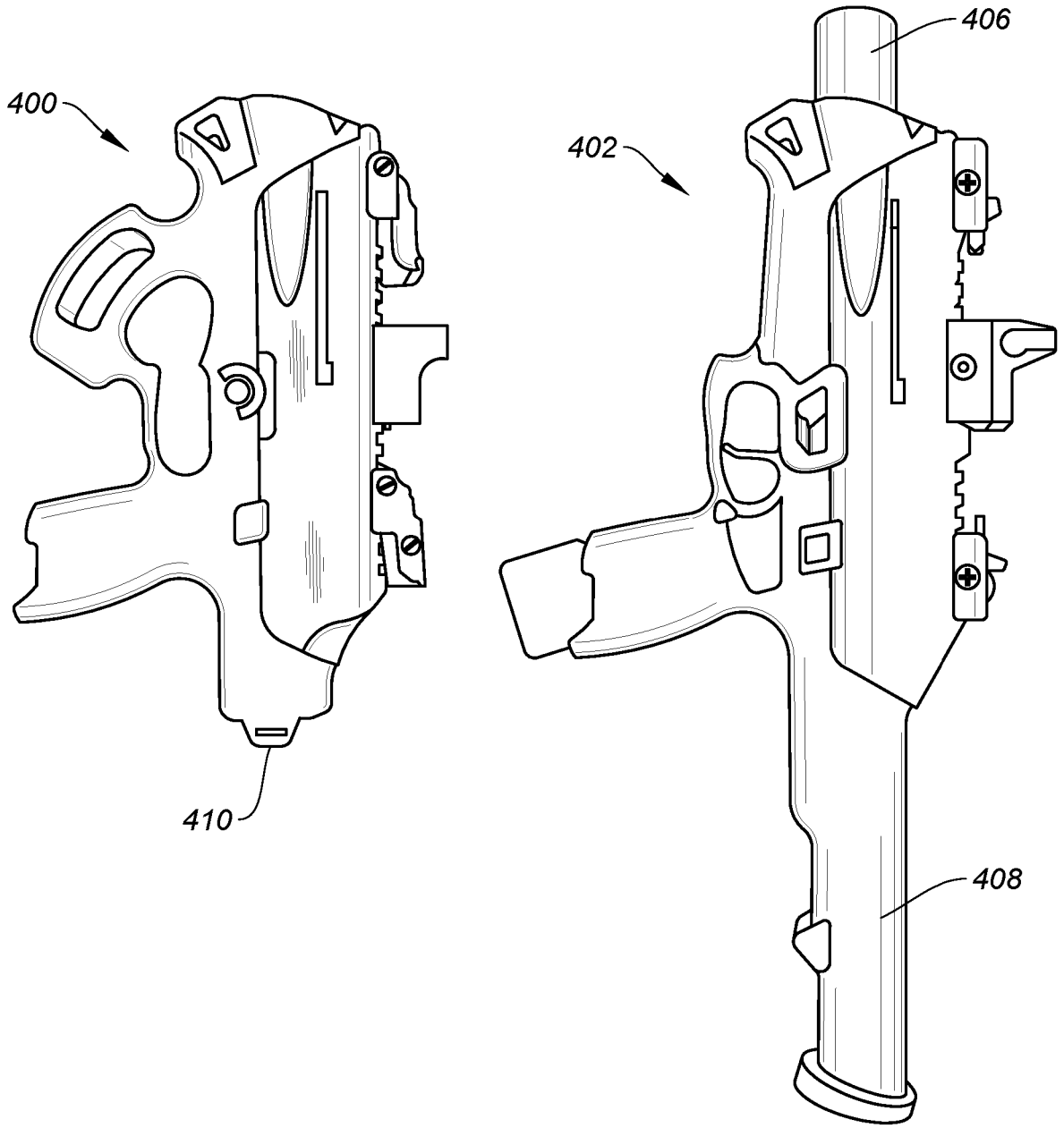
FIG. 4 is a diagram illustrating modified assembly using the grip module in accordance with one embodiment of the present invention.

FIG. 4 illustrates a modified assembly 400 and modified firearm 402 using g the grip module in accordance with one embodiment of the present invention. Assembly 400 which can be a kit without an FCU module. Assembly 400 includes a rear stabilizing connector 410 and upper receiver. Modified firearm 402, in some embodiments, is a fully operational firearm using the grip module with an arm brace 408 and a barrel 406. It should be noted that the underlying concept of the exemplary embodiment(s) of the present invention would not change if one or more components (or elements) were added to or removed from FIG. 4.

Figure 5:
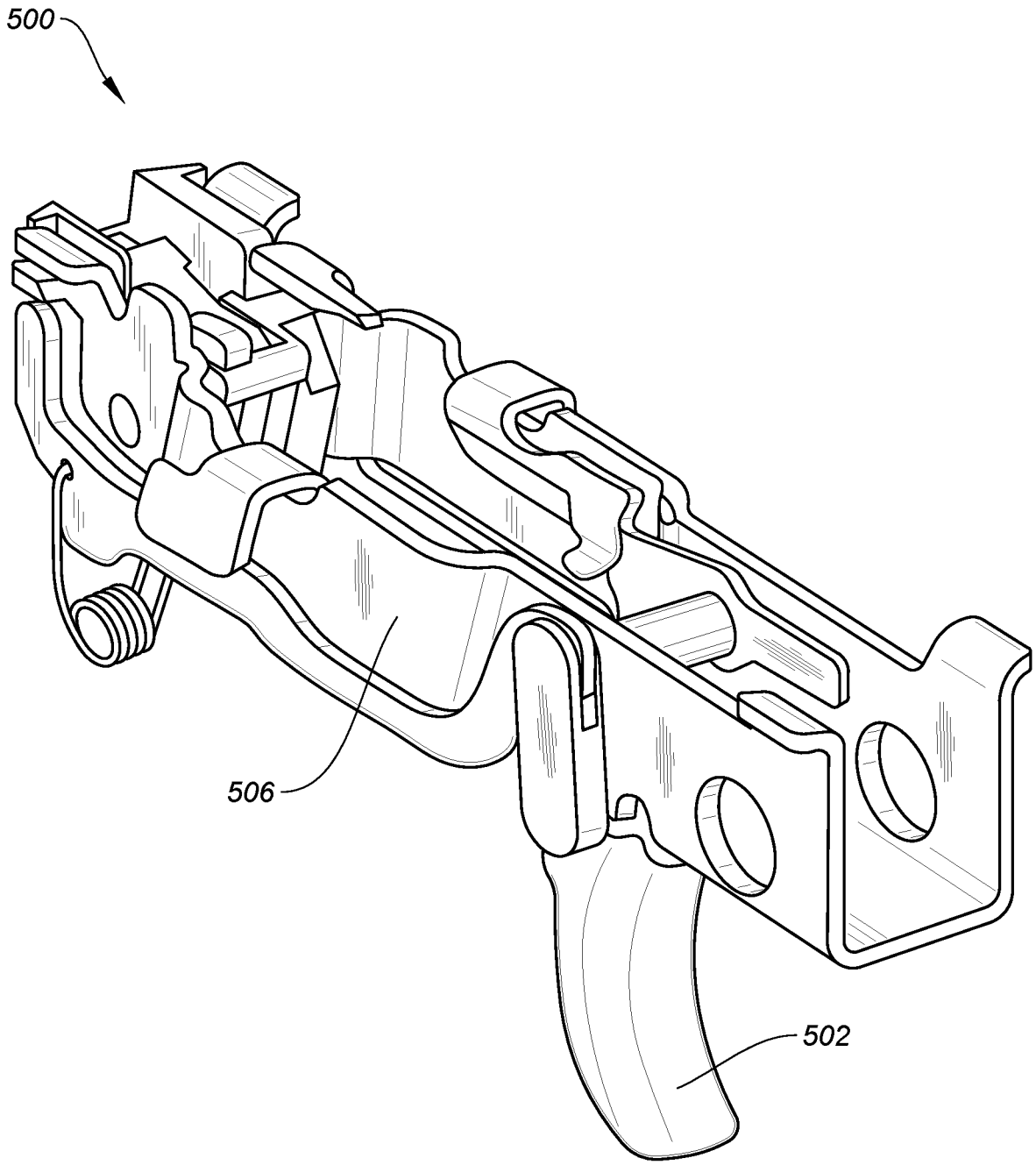
FIG. 5 is a diagram illustrating perspective view of FCU used with the grip module in accordance with one embodiment of the present invention.

FIG. 5 is a diagram 500 illustrating perspective view of FCU used with the grip module in accordance with one embodiment of the present invention. In some embodiments, FCU includes a seral number 506 and a trigger 502. It should be noted that the alternative configurations of FUC can be a control unit without a trigger as trigger 502. It should be noted that the underlying concept of the exemplary embodiment(s) of the present invention would not change if one or more components (or elements) were added to or removed from diagram 500.

The exemplary embodiments of the present invention include various processing steps, which will be described below. The steps of the embodiment may be embodied in machine or instructions.

Figure 6:
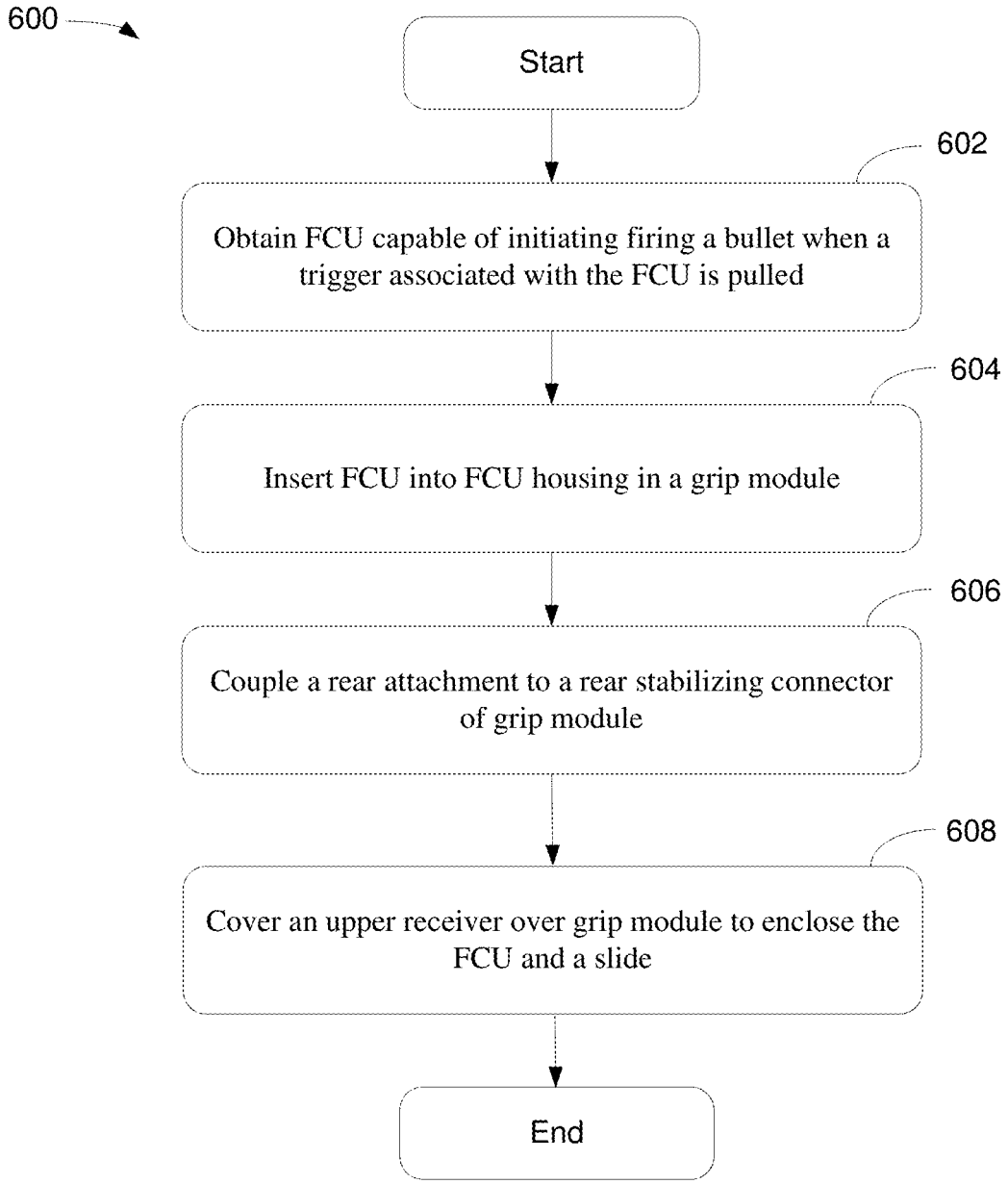
FIG. 6 is a flowchart illustrating a process of modifying a firearm using grip module with an existing FCU in accordance with one embodiment of the present invention.

FIG. 6 is a flowchart 600 illustrating a process of modifying a firearm using grip module with an existing FCU in accordance with one embodiment of the present invention. At block 602, a process of assembling a modified firearm able to fire a bullet via modular components is able to obtain an FCU having a serialized trigger mechanism capable of initiating firing a bullet when a trigger associated with the FCU is pulled. At block 604, the FCU is inserted into an FCU housing in a grip module containing a hand grip and rear stabilizing connector. At block 606, a rear attachment is coupled to the rear stabilizing connector of the grip module for providing stability of the modified firearm during a process of launching the bullet. At block 608, covering an upper receiver covers over the grip module to enclose the FCU and a slide assembly. In one embodiment, the process is capable of disassembling a pistol to separate the FCU from the pistol. A barrel is coupled to the grip module to form a rifle-like firearm utilizing the FCU disassembled from the pistol.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A modified assembly for a propelling an object comprising:

a firing control unit ("FCU") fabricated for a handgun and having a serialized trigger mechanism for launching a directional object when a trigger of the FCU is pulled;

a module structured to have a shape resembling a lower receiver of a submachine gun and configured to contain a hand grip, a magazine, an FCU housing, and a rear stabilizing connector, wherein the FCU housing is configured to house the FCU disassembled from the handgun for a firing mechanism of the module, wherein the hand grip is configured to be hollow for receipt of the magazine and able to guide objects inside the magazine to the serialized trigger mechanism for launching;

an internal component, including a slide assembly and a bolt, configured to situated on top of the FCU when the FCU is inserted in the FCU housing; and an upper receiver configured to couple to the module for enclosing the FCU and the internal component between the upper receiver and the module.

2. The assembly of claim 1, wherein the internal component further includes a return spring configured to be situated in vicinity of the FCU for facilitating object launching process.

3. The assembly of claim 2, further comprising a rear attachment coupled to the rear stabilizing connector and configured to facilitate stability of the modified assembly during a process of launching the object.

4. The assembly of claim 3, wherein the upper receiver includes scope latches capable of receiving a scope for target aiming.

5. The assembly of claim 1, wherein the FCU contains an original serial number for identification purposes; and wherein the module is a grip module containing a serial number window which is located in such a way that when the FCU is inserted in the FCU housing of the grip module, the original serial number shows through the serial number window.

6. The assembly of claim 1, wherein the module is fabricated by one of aluminum, zinc, alloy, composite materials, and pressure resistance plastics.

7. The assembly of claim 1, wherein the FCU is configured to be used in a carbine pistol facilitating firing operation.

8. The assembly of claim 1, wherein the internal component further includes a barrel and return spring configured to be situated in vicinity of the FCU for facilitating object launching process.

9. The assembly of claim 1, wherein the module includes a trunnion for coupling to a barrel.

10. The assembly of claim 1, further comprising a rear attachment which is a buttstock for stability support during a firing process.

11. The assembly of claim 1, further comprising a rear attachment which is an arm brace for stability support during a firing process.

12. The assembly of claim 1, further comprising a rear attachment which is a cheek rest with a magazine holster for stability support during a firing process.

13. The assembly of claim 1, wherein the object is ammunition.

14. The assembly of claim 1, wherein the ammunition is bullets.

15. A firearm capable of firing a bullet comprising the assembly of claim 1.

16. A modified assembly for firing a bullet, comprising:

a firing control unit ("FCU") fabricated for a handgun and configured to fire a bullet from a handgun magazine inside a handgun grip of a handgun receiver via a serialized trigger mechanism;

a grip module structured as a receiver of a submachine gun and configured to contain a hand grip, an FCU housing, and a rear stabilizing connector, wherein the FCU housing is configured to house the FCU which is disassembled from the handgun receiver, wherein the hand grip is configured to be hollow allowing receipt of a magazine and configured to guide bullets inside the magazine to the FCU for firing;

an internal component, including a slide assembly and a bolt, configured to situated on top of the FCU; and an upper receiver configured to couple to the module for enclosing the FCU and the internal component between the upper receiver and the module.

17. The assembly of claim 16, wherein the FCU contains an original serial number for identification purposes.

18. The assembly of claim 17, wherein the grip module contains a serial number window which is located in such a way that when the FCU is inserted in the FCU housing of the grip module, the original serial number shows through the serial number window.

* * * * *